US006009672A

United States Patent [19]

Kuhns

[11] Patent Number: 6,009,672

[45] Date of Patent: Jan. 4, 2000

[54] ROOF VALLEY WATER COLLECTOR

[76] Inventor: Richard L. Kuhns, 210 Broad St., Red Bank, N.J. 07701

[21] Appl. No.: 08/925,690

[22] Filed: Sep. 9, 1997

Related U.S. Application Data

[60] Provisional application No. 60/025,729, Sep. 10, 1996.

[51] Int. Cl.[7] ..... E04D 13/00

[52] U.S. Cl. ..... 52/13; 52/12; 52/15; 52/24; 52/97

[58] Field of Search ..... 52/12, 13, 15, 52/24, 97

[56] References Cited

U.S. PATENT DOCUMENTS

| | | | |
|---|---|---|---|
| 373,129 | 11/1887 | Carroll | 52/13 |
| 2,120,395 | 6/1938 | Dean | 52/12 X |
| 2,537,243 | 1/1951 | Swartz | 52/12 |
| 5,271,191 | 12/1993 | Vahamaki | 52/12 |
| 5,333,417 | 8/1994 | Demartini | 52/12 X |
| 5,333,419 | 8/1994 | Hickner | 52/58 |
| 5,383,310 | 1/1995 | Sapia | 52/12 |

*Primary Examiner*—Beth A. Aubrey
*Assistant Examiner*—Brian E. Glessner
*Attorney, Agent, or Firm*—Thomason, Moser and Patterson

[57] ABSTRACT

A water collector for directing water from roofing configurations that form an inside valley to the rain gutters is disclosed. The device collects the water without the device collecting debris or becoming clogged with leaves or twigs that may interfere with its function.

18 Claims, 2 Drawing Sheets

ROOF VALLEY WATER COLLECTOR

This application claims the benefit of U.S. Provisional Application No. 60/025,729 filed on Sept. 10, 1996.

The invention relates to a water collection device for use with existing rain guttering and roofing. More particularly, the invention relates to a water collector that is positioned within an inside valley of a roof to direct water in a more uniform manner to the guttering.

BACKGROUND OF THE INVENTION

To eliminate clogging of rain gutters by debris, e.g., leaves, various rain gutter covers have been designed to channel water into a rain gutter, while, at the same time, keeping the debris from entering the rain gutter. One such rain gutter cover is disclosed in U.S. Pat. No. 5,216,851 issued Jun. 8, 1993, herein incorporated by reference. Such rain gutter covers function through water adhesion principles that channel water into the gutter via a plurality of apertures formed in the rain gutter cover. These apertures direct the water into the rain gutter while debris of sufficient size is excluded from entering the rain gutter. Typically, such rain gutter covers are attached between a roofline and a lip of the rain gutter along the entire length of the rain gutter.

However, two portions of a roof may meet at an angle (typically, 90 degrees) to form what is known as an inside corner or inside valley. In principle, water flowing along an inside valley flows onto the top flat portion of a gutter cover following a path to the collector portion where, through principles of surface adhesion, the water is delivered into the rain gutter as the debris carried by the water is jettisoned off of the gutter cover. However, the amount of water flowing from an inside valley may exceed the gutter cover's ability to collect the water, thereby permitting much of the water to overflow the gutter cover and to fall onto the ground resulting in soil erosion, basement leakage and so on.

In an attempt to redirect the rain water from the inside valley to a larger cross-section of gutter covers, vertical deflectors or fence-like devices have been installed on the gutter covers. These fence-like devices extend usually 1½ inches to 3 inches in height and are positioned to interrupt the flow of water before it reaches the gutter covers, thereby diverting the water laterally across the roofing or the horizontal portion of the gutter covers. In essence, the fence-like devices spread the large quantity of water within the inside valley across the roof. Unfortunately, tree debris, twigs, leaves, seeds, and so on accumulate behind the fence-like device, thereby reducing its effectiveness in diverting the rain water. Additionally, debris collecting behind the fence-like device contributes to the deterioration of the roofing material itself. To keep the fence-like device functioning, frequent cleaning is required, which is cumbersome, dangerous and contrary to the intended function of the gutter covers, i.e., keeping the rain gutters maintenance-free.

Therefore, there is a need in the art for a maintenance-free water collection device that functions within an inside valley of the roof without collecting debris.

SUMMARY OF THE INVENTION

The present invention overcomes the disadvantages associated with the prior art. Specifically, the present invention is a water collector for collecting water from roofing that forms an inside valley. The device provides the additional advantage of collecting the water without the device collecting tree debris or becoming clogged with leaves or twigs that may interfere with its function.

The present water collector includes a unitary sheet of metal or plastic such as aluminum, steel or vinyl. This unitary sheet includes an extended flat top portion, which functions as a closed-top portion for covering a lower portion of the inside valley at the gutter juncture. The flat top portion also serves to interfit under and between existing roof materials of the inside valley, such as roof shingles, to securely fasten the invention to the roof. The top portion provides a relatively uninterrupted smooth path for rain water to travel from the inside valley and onto the top portion. The top portion has ridges for spreading water toward the edges of a gutter cover adjacent to the roofline. The top portion is connected along the front thereof to an arcuate surface (portion) that directs the water downward. The arcuate portion extends into a vertically disposed front portion. The front portion may contain one or more longitudinally extending, generally horizontally disposed rows of interrupted apertures. The interruptions of apertures in each row can be displaced horizontally with respect to the interruptions of the apertures in the next adjacent row, such that there is no path of rain flow down the front portion, which is not interrupted by at least one of the apertures. However, the present invention can also be implemented without any apertures on the front portion.

More specifically, each aperture contains an inwardly and downwardly extending flap provided along the top edge of the aperture, where the flap receives and diverts rain water into the aperture. The front portion can be attached to a conventional rain gutter cover that is mounted just below the water collector. As such, the rain water channeled into the apertures of the present invention is further channeled onto the top of a conventional gutter cover that extends along the gutter adjacent to the roofline.

The present invention is designed as an integral unit so that leaves, for example, and other debris which may clog the valley and gutter can neither enter the gutter nor clog the invention. The water collector is also designed such that it remains stationary without the use of fasteners or glue strips at the shingle interface and can be easily installed by a single unskilled person.

BRIEF DESCRIPTION OF THE DRAWINGS

The teachings of the present invention can be readily understood by considering the following detailed description in conjunction with the accompanying drawing, in which.

To facilitate understanding, identical reference numerals have been used, where possible, to designate identical elements that are common to the Figures.

DETAILED DESCRIPTION

In accordance with the present invention, a rain water collector is provided which can be installed in existing roof valley configurations in conjunction with existing guttering with or without gutter covers. The present water collector is installed in a manner that does not require fastening devices to be applied to the roofing materials. Hence, it is easily installed generally by a single, unskilled person, and it is easily removed and replaced without damaging the roofing.

Figure 1:
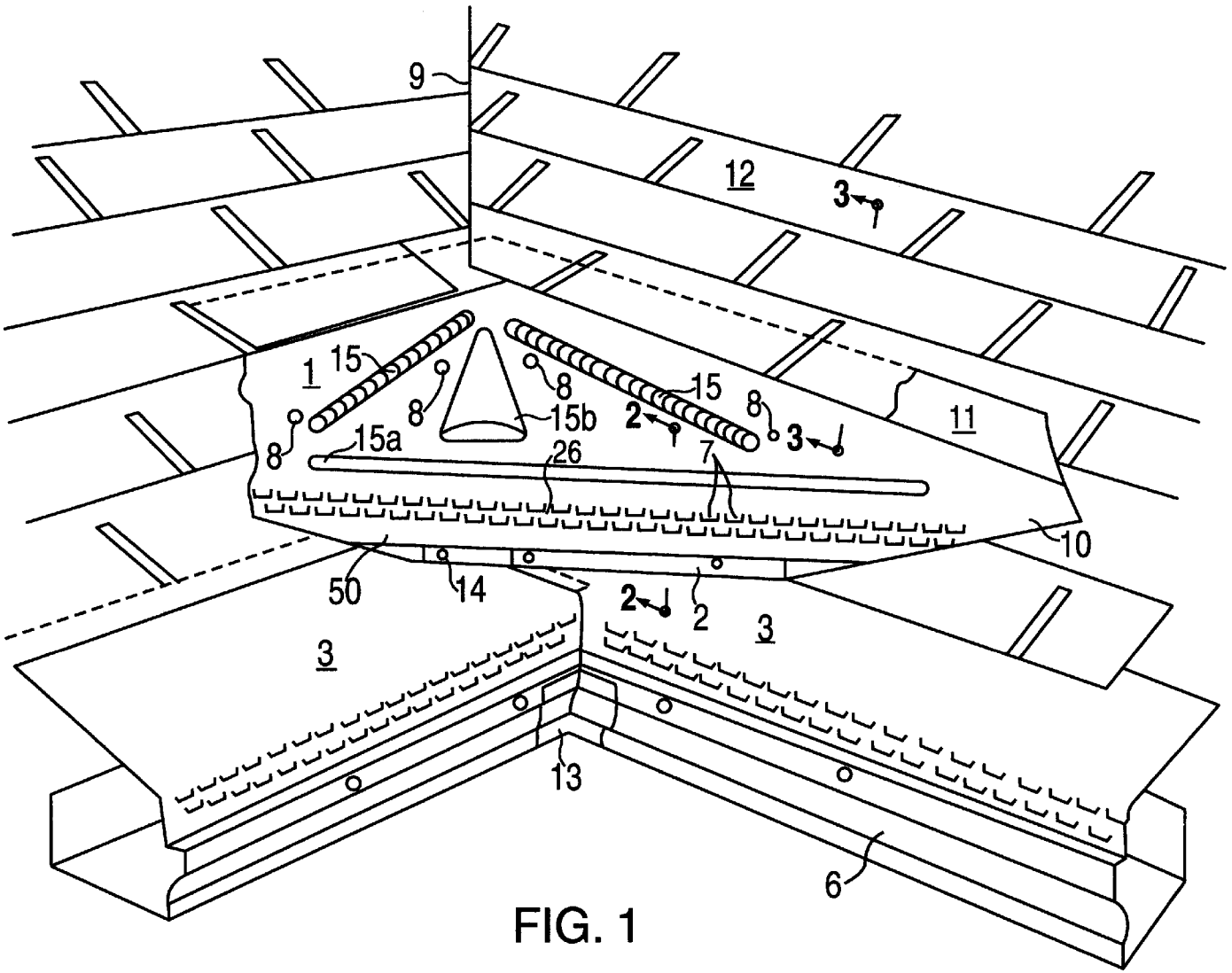
FIG. 1 is a perspective view of the preferred embodiment of the present water collector.
Figure 2:
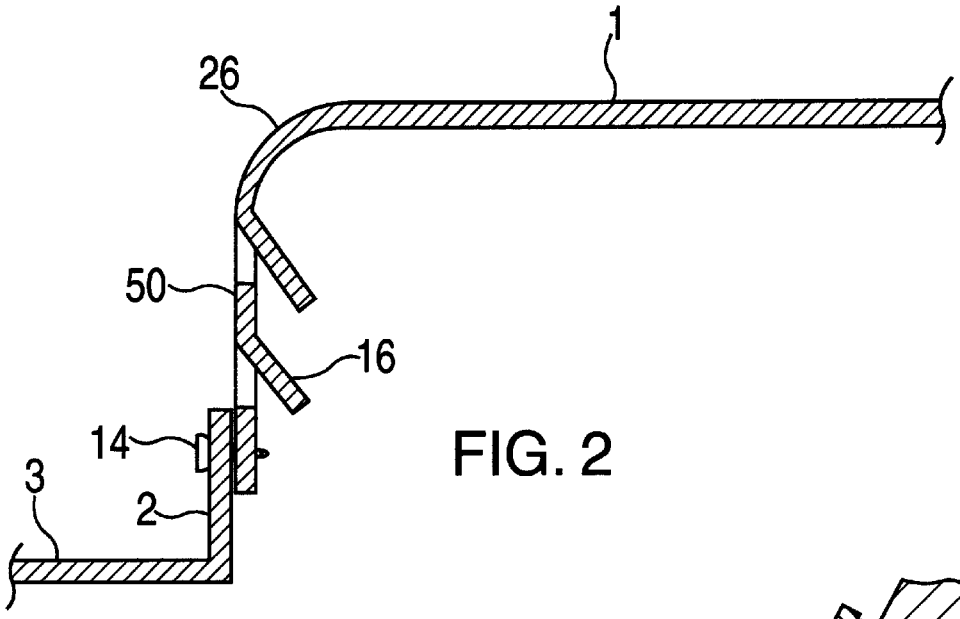
FIG. 2 is a sectional view of the preferred embodiment of the present water collector taken along line 2—2 of FIG. 1.
Figure 3:
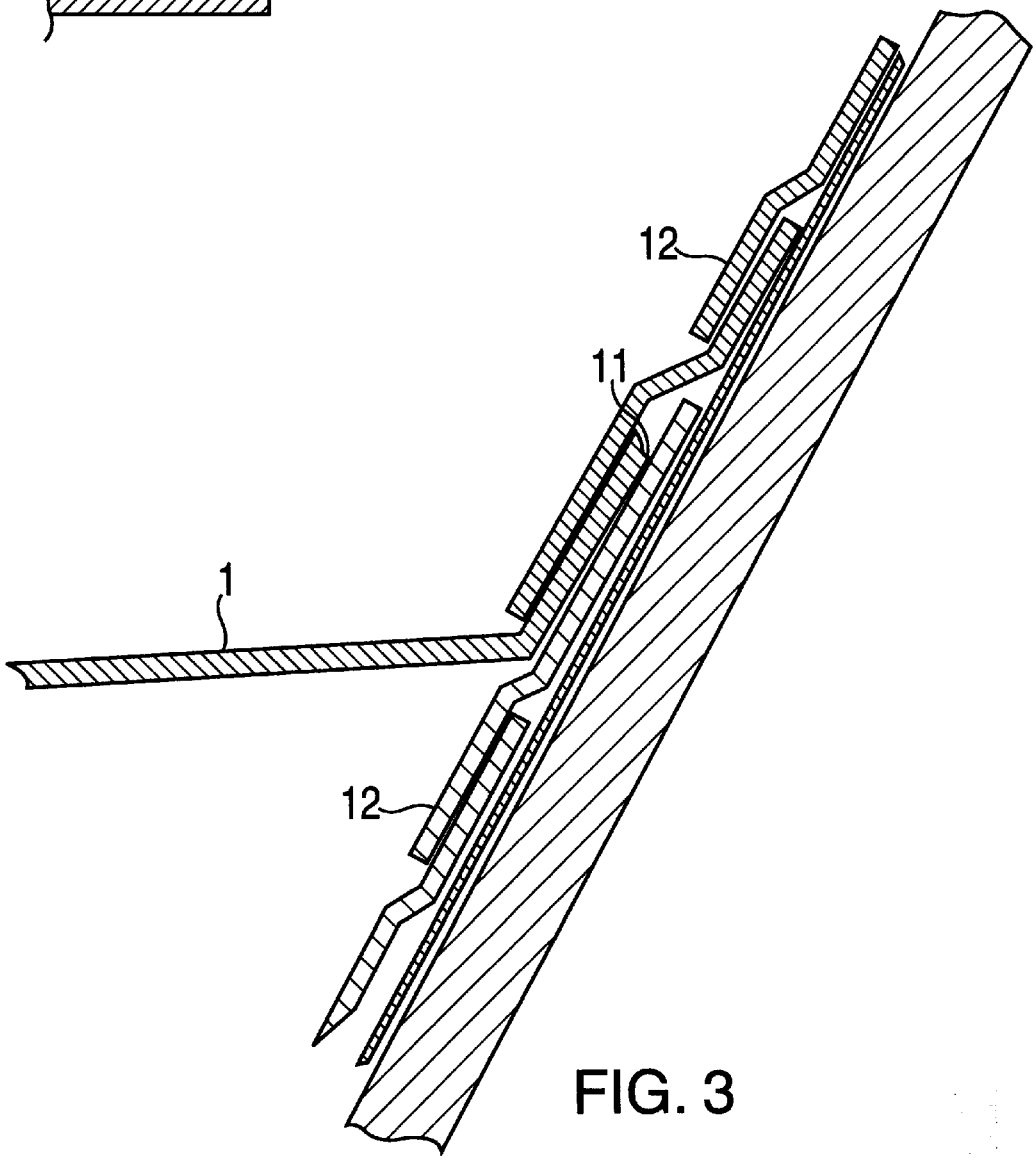
FIG. 3 is a sectional view of the preferred embodiment of the present water collector taken along line 3—3 of FIG. 1.

Referring to FIGS. 1–3, a rain water collector 10 is provided for an inside valley roofing configuration created by two intersecting rooflines 9. Such intersecting rooflines lead to a configuration of guttering connected at an angle, e.g., a right angle (at point 13). However, it should be understood that the present water collector can be implemented to accommodate a roofing juncture of any angles.

The water collector 10 has a closed-top portion 1 having a substantially triangular shape and a front portion 50. In the preferred embodiment, an arcuate front portion 26 is disposed between top portion 1 and front portion 50. Although the present invention is described below with an arcuate front portion 26, it should be understood that the present invention can be modified and implemented without the arcuate front portion 26.

More specifically, the arcuate front portion 26 extends from the top portion into a vertically disposed front portion 50. The front portion 50 may have a plurality of apertures 7 to direct rain water into a rain gutter. However, if a rain gutter cover 3 is available, vertically disposed front portion 50 can be attached along its bottom edge to a flange 2 of the rain gutter cover 3. Water collector 10 is constructed of a unitary sheet of constructed metal such as aluminum, aluminum copper alloy, vinyl or other weather resistant plastic. In one illustrative example, the unitary sheet has a length of approximately three (3) feet and a width of between 8 and 20 inches.

Although the present invention is implemented as a unitary sheet, those skilled in the art will realized that the present invention can be implemented having more than one sheet of material. Furthermore, it should be understood that the size (including the angles between the various portions of the water collector) of the present water collector can be adjusted to accommodate the dimension of a particular roof valley. For example, the front portion 50 does not have to form a right angle with respect to the top portion 1, i.e., these portions are not limited to a horizontal or a vertical configuration. Both portions can be implemented with a slope or pitch with respect to a horizontal or vertical axis.

The top portion 1 is installed such that the front arcuate portion 26 is substantially level (e.g., horizontal) and the top portion 1 is slightly pitched (e.g., 1 to 15 degrees) away from the valley. Such pitch enables water to drain toward the front arcuate portion 26 from an optional rear flap 11 extending from the top portion 1 at an angle that matches the slope of roofing 12. Rear flap 11 is optional, since it is possible to fabricate the water collector such that the top portion 1 is pitched at an angle that matches the slope of roofing 12, thereby allowing a portion of the top portion 1 to be directly inserted between the roofing material without the need of a rear flap. However, if the slope of the roofing 12 is particularly sharp, the angled rear flap allows the top portion 1 to be pitched slightly, i.e., having a less inclined slope than the roofing, thereby allowing the rain water to spread out as it travels across the top portion 1. Therefore, it is generally preferred to incorporate an angled rear flap on the water collector for roofing that has a sharp slope.

To install the water collector 10, flap 11 is slid between the roofing material such as roof shingles, to cause the water collector 10 to be stationary with respect to the roofing as shown in FIG. 3. To complete the installation, the bottom portion of vertically disposed front portion 50 is fastened with screws, rivets or clips 14 to the flange 2 of the top flat portion of gutter cover 3 as shown in FIG. 2. In the event that a gutter cover 3 is not used, the bottom portion of vertically disposed front portion 50 can be attached directly to the rain gutter 6.

The top portion 1 is also provided with longitudinal ridges or weirs 15 extending approximately ⅛ inches to ½ inches in height for spreading water to the edges of the collector adjacent to the roofing. The purpose of these ridges is to distribute the rain over a greater surface, so that the rain can be directed into the rain gutter at different points. Although a set of ridges 15 is shown in FIG. 1, those skilled in the art will realize after considering this specification that ridges of different quantity, shape and size can be employed on different locations on the top portion 1 to achieve the same effect.

For example, in an alternate embodiment, a single ridge 15*a* which is parallel to the front arcuate portion 26, may extend substantially across the entire width of the water collector. In yet another embodiment, a single ridge 15*b* which starts near the juncture of the rooflines, may extend horizontally and vertically toward the arcuate portion 26. This ridge 15*b* may have a dome like shape.

The vertical front portion 50 may contain one or more rows of a plurality of apertures 7, where each aperture contains a flap 16 connected to the top of the aperture, such that the flap 16 extends inwardly toward the rain gutter. These apertures can be formed integrally with the substantially vertical front portion 50 by stamping, piercing, or die cutting the flaps from the front portion and by bending the flaps inwardly.

Due to the principle of surface adhesion, rain traversing over the top of the aperture 7 is drawn into the aperture via the flap 16. The configuration of these rows of apertures is such that all generally vertical paths of rain flow downwardly across the vertical front portion 50, are interrupted by at least one of these apertures 7. The size of these apertures (approximately ½ inch by ¾ inch) should be sufficiently small so as to generally prevent leaves and other debris from entering the rain gutter. Those skilled in the art will realize after considering this specification that apertures of different quantity (including the number of rows), shape and size can be employed to achieve the same water channeling effect.

Referring to FIG. 1, the top portion 1 can also be optionally provided with openings 8 for the purpose of directing rain into the rain gutter. Again, the size of these openings (approximately 1/16 inch to ¼ inch in diameter) should be sufficiently small so as to generally prevent leaves and other debris from entering the rain gutter. These openings 8 are typically distributed over the surface of top portion 1 to enhance the guidance of rain water into the rain gutter. Since water collector 10 is positioned directly over both a portion of the roofing 12 and the rain gutter 6, water entering these openings 8 is either directed to the rain gutter 6 directly or to a different portion of the roofing 12 underlying the water collector 10. In both cases, the desired effect of spreading and directing rain water from the inside valley of a roof into a rain gutter 6 is accomplished.

Those skilled in the art after considering this specification will realize that this water collector 10 can be modified to adopt to valley configurations adjacent to non-connecting guttering at right angles as well as valleys having no roof edge which is adjacent to guttering, or valleys created by a dormer leading to straight guttering. Those skilled in the art after considering this specification will also realize that this water collector 10 can be modified to work with all types of roofing, including but not limited to, wood shingles, metal, slate, tile, and so on. In fact, the present water collector 10 can be used with open unprotected guttering.

Although various embodiments which incorporate the teachings of the present invention have been shown and described in detail herein, those skilled in the art can readily devise many other varied embodiments that still incorporate these teachings.

What is claimed is:

1. A water collector in combination with two adjoining roof surfaces, that form a roof valley, and a rain gutter having an elongated trough defined by a front wall, a bottom portion, and a rear wall, said rain gutter is disposed below said roof surfaces, the water collector comprising:

a substantially triangular top portion that is coupled to the two adjoining roof surfaces, that form said roof valley; and a front portion extending at an oblique angle from said top portion, said front portion is coupled to said rain gutter, wherein said front portion is adapted to divert water into the rain gutter, and wherein said substantially triangular top portion is adapted to spread water across the substantially triangular top portion away from the roof valley toward said front portion.

2. The water collector of claim 1, wherein said front portion further comprises one or more apertures for diverting the water into the rain gutter.

3. The water collector of claim 2, wherein each of said apertures of said front portion includes:

a top edge; and a flap extending from said top edge inwardly away from said front portion.

4. The water collector of claim 1, wherein said top portion further comprises one or more apertures for diverting the water into the rain gutter.

5. The water collector of claim 1, wherein said top portion further comprises a ridge extending up from a top surface of said top portion for directing the water across said top surface of said top portion.

6. The water collector of claim 1, wherein said top portion further comprises a rear flap that is inclined relative to said top portion and where said rear flap is matched to a slope of the roof valley.

7. The water collector of claim 1, further comprising an arcuate front portion disposed between said top portion and said front portion.

8. An apparatus in combination with two adjoining roof surfaces, that form a roof valley, a rain gutter, said rain gutter having an elongated trough defined by a front wall, a bottom portion, and a rear wall, and a rain gutter cover having an opening with a flange, said rain gutter cover disposed above said elongated trough of said rain gutter, and said rain gutter and said rain gutter cover are disposed below said roof surfaces, the apparatus comprising:

a substantially triangular top portion that is coupled to the two adjoining roof surfaces, that form said roof valley; and a front portion extending at an oblique angle from said top portion, said front portion is coupled to said rain gutter cover, wherein said front portion is adapted to divert water into the rain gutter, and wherein said substantially triangular top portion is adapted to spread water across the substantially triangular top portion away from the roof valley toward said front portion.

9. The apparatus of claim 8, wherein said front portion further comprises-one or more apertures for diverting the water into the rain gutter cover, wherein said apertures are of a predetermined size to prevent leaves and debris from entering the rain gutter.

10. The apparatus of claim 9, wherein said plurality of apertures in said front portion is positioned in a plurality of horizontally disposed rows, where all vertical paths of water flow downwardly across said front portion are interrupted by at least one of said apertures.

11. The apparatus of claim 9, wherein each of said apertures of said front portion includes:

a top edge; and a flap extending from said top edge inwardly away from said front portion.

12. The apparatus of claim 8, wherein said top portion further comprises one or more apertures for diverting the water into the opening of the rain gutter cover.

13. The apparatus of claim 8, wherein said top portion further comprises a ridge extending up from a top surface of said top portion for directing the water across said top surface of said top portion.

14. The apparatus of claim 8, wherein said top portion further comprises a rear flap that is inclined relative to said top portion and where said rear flap is matched to a slope of the roof valley.

15. The apparatus of claim 8, wherein said front portion is coupling to the flange of the rain gutter cover.

16. The apparatus of claim 8, wherein said apparatus is formed from a unitary sheet of metal or plastic.

17. The apparatus of claim 8, further comprising an arcuate front portion disposed between said top portion and said front portion.

18. The apparatus of claim 11, wherein said apertures are formed by stamping, piercing, or die cutting said flaps from said front portion.

* * * * *